US009212470B2

(12) United States Patent
Amundson

(10) Patent No.: US 9,212,470 B2
(45) Date of Patent: Dec. 15, 2015

(54) QUICK RELEASE HOSE GUIDE

(75) Inventor: Jeremy A. Amundson, Willmar, MN (US)

(73) Assignee: Clark Equipment Company, West Fargo, ND (US)

( * ) Notice: Subject to any disclaimer, the term of this patent is extended or adjusted under 35 U.S.C. 154(b) by 1679 days.

(21) Appl. No.: 12/474,506

(22) Filed: May 29, 2009

(65) Prior Publication Data

US 2009/0294603 A1 Dec. 3, 2009

Related U.S. Application Data

(60) Provisional application No. 61/057,021, filed on May 29, 2008.

(51) Int. Cl.

| | |
|---|---|
| ***B05B 15/06*** | (2006.01) |
| ***E02F 9/22*** | (2006.01) |
| ***E02F 3/36*** | (2006.01) |

(52) U.S. Cl.
CPC ..... *E02F 9/2275* (2013.01); *E02F 3/3654* (2013.01)

(58) Field of Classification Search
USPC ..... 248/75, 74.2
See application file for complete search history.

(56) References Cited

U.S. PATENT DOCUMENTS

| | | | | |
|---|---|---|---|---|
| 2,879,020 | A | 3/1959 | Wheeler | |
| 3,851,672 | A | 12/1974 | De Vincent et al. | |
| 3,906,592 | A | 9/1975 | Sakasegawa et al. | |
| 4,234,012 | A | 11/1980 | Schupback | |
| 5,082,217 | A | 1/1992 | Parker et al. | |
| 5,222,754 | A | 6/1993 | Few | |
| 5,460,418 | A * | 10/1995 | Falls | 292/329 |
| 5,542,339 | A * | 8/1996 | Kaczmarczyk et al. | 91/508 |
| 6,023,927 | A * | 2/2000 | Epstein | 59/86 |
| 6,568,894 | B2 * | 5/2003 | Golden et al. | 411/351 |
| 6,830,075 | B1 | 12/2004 | McKinney et al. | |

(Continued)

FOREIGN PATENT DOCUMENTS

| | | | |
|---|---|---|---|
| EP | 1870525 | A1 | 12/2007 |
| JP | 2006328848 | A | 12/2006 |

(Continued)

OTHER PUBLICATIONS

Communication from the European Patent Office dated Jan. 11, 2011 for European application No. 09755259.0, filed May 28, 2009.

(Continued)

*Primary Examiner* — Monica Millner
(74) *Attorney, Agent, or Firm* — John D. Veldhuis-Kroeze; Westman, Champlin & Koehler, P.A.

(57) ABSTRACT

Disclosed embodiments provide various quick release hose guide designs which can be attached to, or removed from, a work machine with less effort than conventionally required. Exemplary embodiments of the hose guides include a sleeve which slides over a post on the work machine when hydraulic hoses of an attachment are to be connected to the hydraulic system of the work machine. A quick release pin is inserted through apertures in the sleeve and in the post to secure the hose guide in place. A snap clip connected to the pin can then be used to help insure that the pin remains in place. In some embodiments, unlike conventional hose guide designs, the hose guides remain with the attachment or implement hoses when the attachment is removed from the work machine.

15 Claims, 14 Drawing Sheets

(56) References Cited

U.S. PATENT DOCUMENTS

| | | | | |
|---|---|---|---|---|
| 7,740,209 | B2 * | 6/2010 | Neumann et al. | 248/49 |
| 2001/0054807 | A1 | 12/2001 | Homan et al. | |
| 2008/0048073 | A1 | 2/2008 | Royer | |
| 2008/0078891 | A1 | 4/2008 | Hobson | |

FOREIGN PATENT DOCUMENTS

| | | | |
|---|---|---|---|
| JP | 2007231670 | A | 9/2007 |
| JP | 2008007951 | A | 1/2008 |

OTHER PUBLICATIONS

International Search Report and Written Opinion for international patent application No. PCT/US2009/003251, mailed Sep. 4, 2009.

Office Action dated Jan. 29, 2012 for Chinese patent application No. 200980119764.X filed May 28, 2009, 6 pages.

* cited by examiner

QUICK RELEASE HOSE GUIDE

BACKGROUND

In work machines such as skid steer loaders, the vehicles are typically driven using hydraulic power. Various implements or attachments can be removably attached to the work machine to perform specific functions. A few of the many examples of these various attachments include buckets, blades, stump grinders, excavation arms, lawn mowers, and snow blowers. Often, these attachments also require hydraulic power to perform their intended function.

Providing hydraulic power to attachments of a work machine typically requires routing of hydraulic hoses from the attachment to the hydraulic system of the work machine. However, care must be taken to prevent damage to these hydraulic hoses. Damage to the hoses can be caused, for example, by the work machine's tires or by pinch points which can occur due to pivoting or other movement of the attachment, of the machine or its arms, or of other components.

Hose guides can be used to aid in the routing of hydraulic hoses to work machine attachments. The hose guides route the hoses by securing the hoses to structural members of the work machine, such as a side boom of a skid steer loader. Frequently, the hose guides secure the hoses in a manner which allows at least some degree of longitudinal movement of the hoses. The hose guides are typically fixed to the work machine, and hoses are thread through the hose guide whenever an attachment is coupled to, or removed from, the work machine.

Routing of the hoses by threading them through the hose guides can be a time consuming task. For example, in some conventional hose guides, relatively large diameter hoses must be threaded through a hose guide ring every time a particular attachment is to be coupled to the work machine. This in turn adds to the time and difficulty to the task of changing attachments. It also potentially causes wear and tear on the hoses.

The discussion above is merely provided for general background information and is not intended to be used as an aid in determining the scope of the claimed subject matter.

SUMMARY

Disclosed embodiments provide various quick release hose guide designs which can be attached to, or removed from, a work machine with less effort than conventionally required. Exemplary embodiments of the hose guides include a sleeve which slides over a post on the work machine when hydraulic hoses of an attachment are to be connected to the hydraulic system of the work machine. A quick release pin is inserted through apertures in the sleeve and in the post to secure the hose guide in place. A snap clip connected to the pin can then be used to help insure that the pin remains in place. In some embodiments, unlike conventional hose guide designs, the hose guides remain with the attachment or implement hoses when the attachment is removed from the work machine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 2-1 is a perspective view of a post, affixed to a portion of a work machine or a work machine attachment, forming a component of a quick release hose guide in accordance with an example embodiment.

FIG. 2-2 is a side view of the quick release hose guide post shown in FIG. 2-1.

DETAILED DESCRIPTION

Disclosed are various embodiments of a quick release hose guide concept which secures and guides hoses, on a work machine, which provide hydraulic power to an attachment of the work machine. The hose guide protects hoses from damage, while at the same time simplifying the hose routing process, providing a more convenient method of putting on and taking off hydraulically driven work machine attachments or implements, and/or provides other advantages over conventional hose guides.

Figure 1:
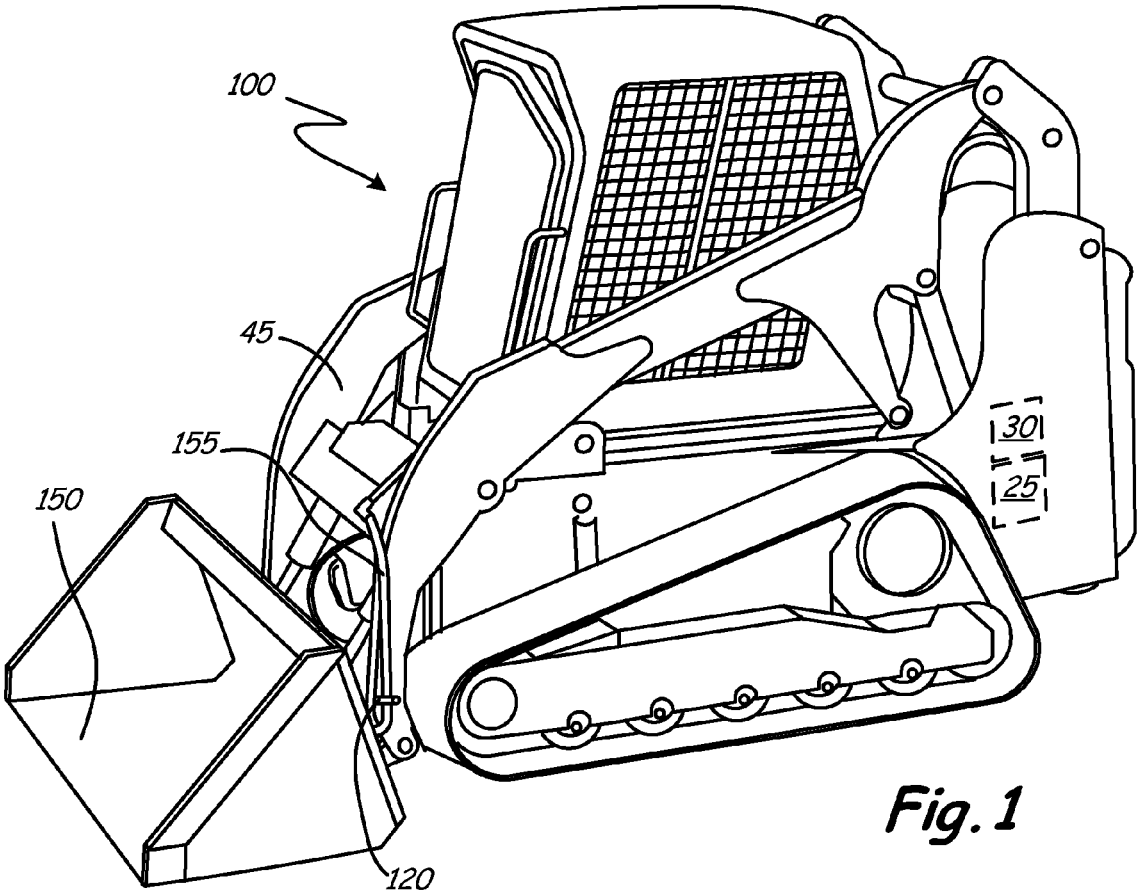
FIG. 1 is a view of a work machine and a work machine implement or attachment including a quick release hose guide in accordance with disclosed embodiments.

FIG. 1 illustrates a work machine 100 and a hydraulically powered implement or attachment 150. Although work machine 100 is illustrated in FIG. 1 as a track loader vehicle, work machine can be other types of carrier machines which work with hydraulically powered attachments. For example, work machine 100 can be a skid steer loader as illustrated in other FIGS. Still other types of work machines can be used as work machine 100. Also, while attachment 150 is illustrated in FIG. 1 to be a bucket type attachment, attachment 150 can be any type of hydraulically powered attachment for a work machine. Work machine 100 includes, in an example embodiment, a hydraulic system 25, an engine 30, and attachment structural supporting members such as arms 45. Other components of work machine 100, such as actuators, track carriages, etc., are shown but are not specifically described.

Engine 30 drives one or more hydraulic pumps within the hydraulic system 25, and the pumps provide a flow of hydraulic fluid to actuators and hydraulic drive systems of the work machine. The hydraulic systems 25 also provide hydraulic fluid, through hoses 155, to work machine attachments 150. As will be described below in greater detail, quick release hose guides 120 are employed in disclosed embodiments to guide and protect the hydraulic hoses 155. Quick release hose guide 120 can be placed on hoses 155 and left with the attachment when the attachment is decoupled from work machine 100. Then, when attachment 150 is to be coupled to work machine 100, quick release hose guide 120 can be quickly recoupled to the work machine as described below. Various quick release hose guide embodiments, and quick release hose guide systems including the quick release hose guides and mounting posts on the work machine or other structural surface, are described below.

Figures 1, 2:
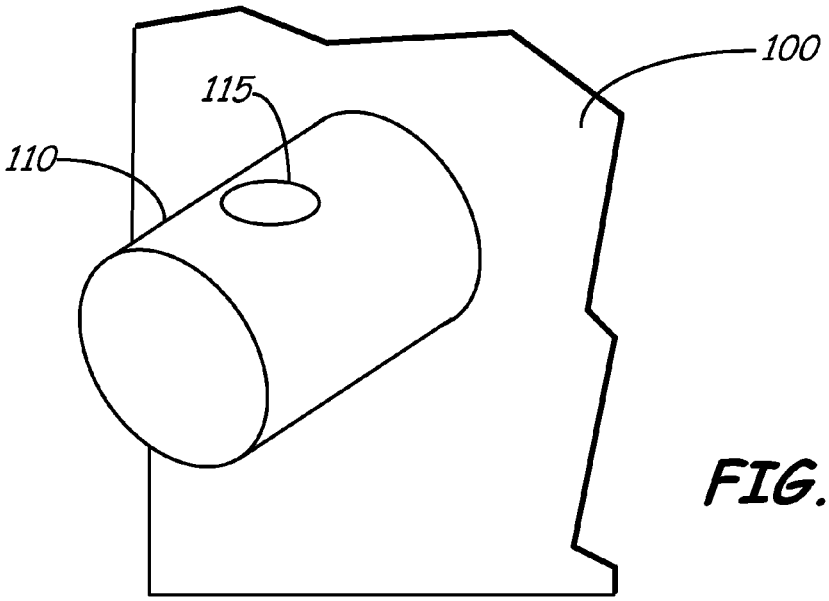
Figure 2:
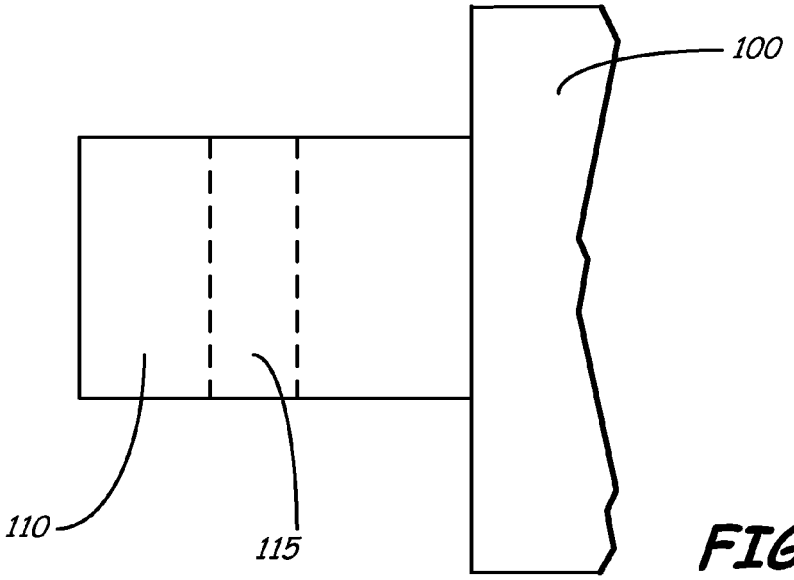

FIGS. 2-1 and 2-2 are a perspective view and a side view, respectively, of a portion of a hose guide system in accordance with some disclosed embodiments. As shown in FIG. 2-1, a post 110 is welded or otherwise attached to a portion of work machine 100 to which the hose guide is to be attached for purposes of routing hydraulic hoses from an attachment. Other methods of attachment of post 110 to work machine 100 can be used as well, for example including bolting, riveting, etc. Also, in other embodiments, post 110 can be formed integrally with a portion of work machine 100 as a single cast piece, etc.

Post 110 has one or more apertures 115 extending through the post. The aperture(s) or cross drill can be oriented in any of a variety of directions as desired, and will be aligned with apertures in a sleeve of a hose guide as described further below. It must be noted that while a cylindrical post is illustrated in FIGS. 2-1 and 2-2, other post shapes can also be used. For example, cuboids or other rectangular prisms, triangular prisms, or other shaped posts can be used. Also, in other embodiments, a mechanism other than a post can be used to attach the hose guide to the work machine in a quick release fashion.

Figure 3:
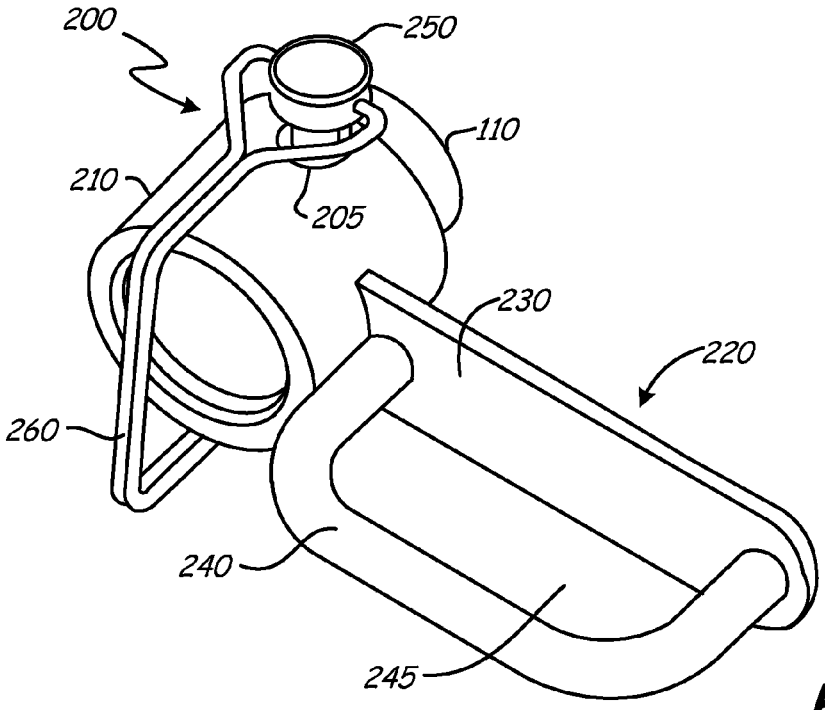
FIG. 3 is a perspective view of a first embodiment of a quick release hose guide.
Figure 4:
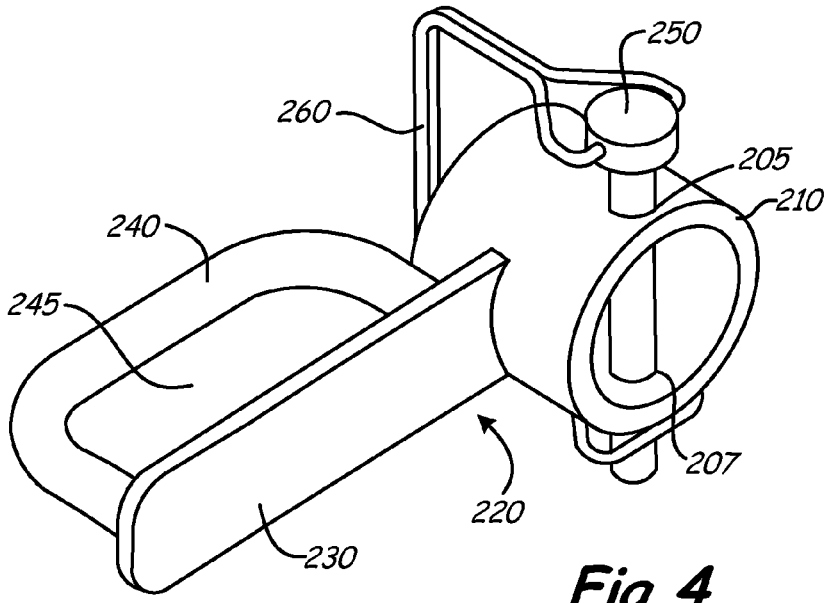
FIG. 4 is another perspective view, from the opposite side, of the quick release hose guide shown in FIG. 2-1.

Referring now to FIGS. 3 and 4, shown are perspective views of a first embodiment of a quick release hose guide (e.g., a first embodiment of quick release hose guide 120). Quick release hose guide 200 includes a sleeve 210 having a shape which corresponds to the shape of post 110 (shown only in FIG. 3), and inner dimensions (e.g., an inner diameter for a cylindrical post shape) which are slightly larger than the outer dimensions of post 110 such that sleeve 210 can be slid onto post 110, and will initially be held in place at least partially via this contact with post 110.

Hose guide 200 has a hose guiding portion 220 which is either attached to, or is formed integrally with, sleeve 210. For example, hose guiding portion 220 can be welded to sleeve 210. In other embodiments, sleeve 210 and hose guiding portion 220 are formed integrally from as a single cast aluminum (or other metal) piece, as a single injection molded plastic piece, or by other manufacturing techniques such as stamping.

Hose guiding portion 220 includes, in one example embodiment, a base portion 230 and a D-ring portion 240, together forming an area 245 through which hoses can be threaded. Typically, the attachment's hydraulic hoses are thread through area 245 (i.e., through the D-ring) in a factory setting, so that purchasers or end users of the equipment do not need to perform this portion of the hose guiding effort. As will be described further below, unlike conventional hose guides, hose guide 200 can then remain with the attachment whenever the attachment is removed from the work machine.

Sleeve 210 of hose guide 200 includes a cross drill or apertures 205 and 207, which are configured to align with apertures 115 in post 110. When an attachment is to be connected to work machine 100, the hose guide 200, through which the attachment's hoses have been thread, is attached to post 110. Sleeve 210 is slid over post 110, and apertures (e.g., apertures 205 and 207) in sleeve 210 are aligned with apertures (e.g., apertures 115) in post 110. A quick pin 250 is then inserted through the apertures in the sleeve and post to secure the sleeve to the post. In many embodiments, a snap clip 260, which is connected to one end of pin 250, is snapped over a second end of pin 250 in order to further keep pin 250 in place to secure hose guide 200 to work machine 100. To remove the attachment from the work machine, the snap clip 260 is opened (removed from the second end of pin 250), and pin 250 is removed from the apertures in post 110 and sleeve 210. Sleeve 210 is slid off of post 110, and hose guide 200 remains with the hoses of the attachment.

Figure 5:
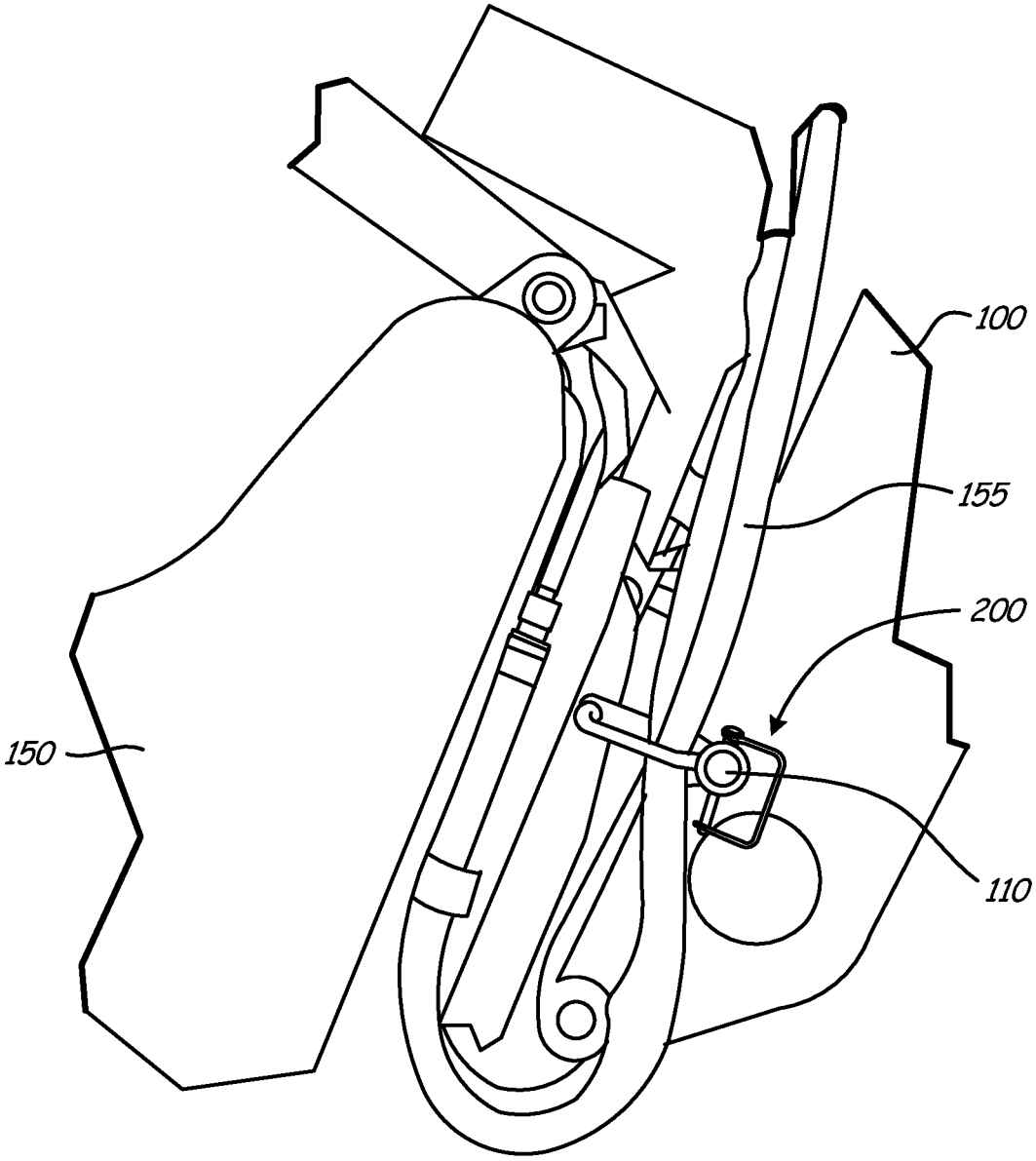
FIG. 5 is a side view of a portion of a work machine, such as a loader, having the quick release hose guide of FIG. 2-1 coupled to an arm or side boom of the work machine.

Referring now to FIG. 5, shown is attachment 150 coupled to a boom or arm of work machine 100, with hoses 155 of the attachment connected to the hydraulic system of the work machine. Hose guide 200 is shown securing the hoses to the work machine (via post 110) in the quick release fashion described above.

Figure 6:
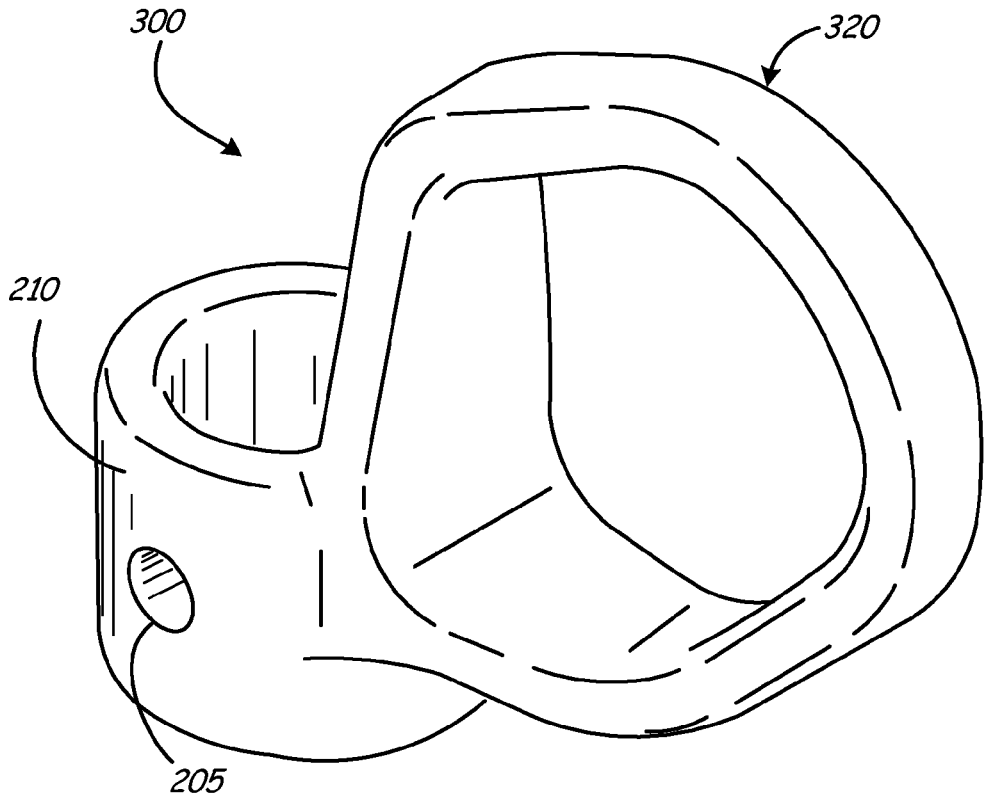
FIG. 6 is a perspective view of a second embodiment of a quick release hose guide.
Figure 7:
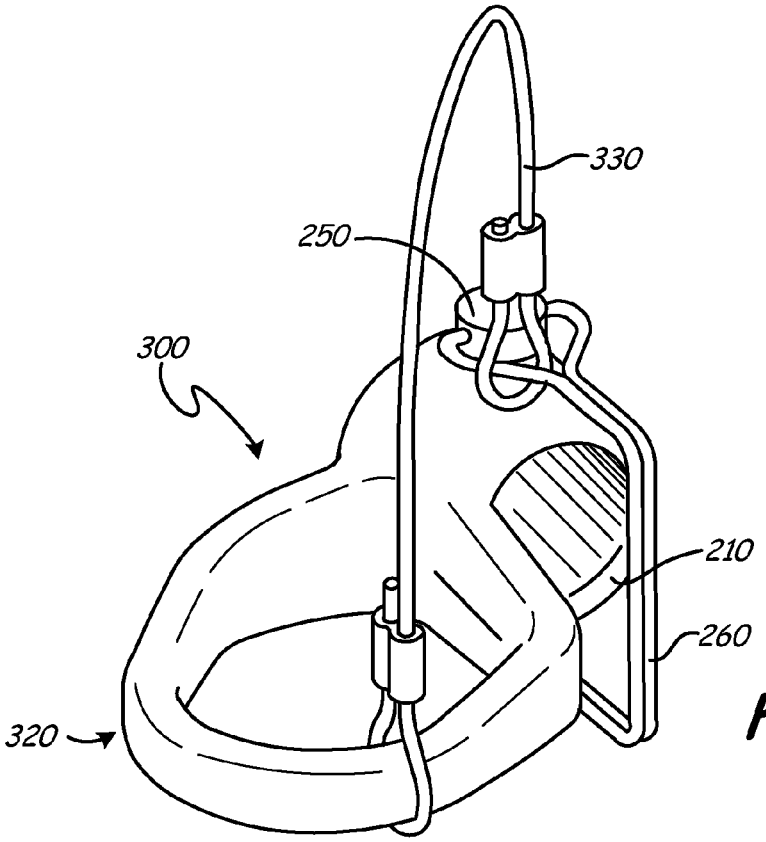
FIG. 7 is another perspective view of the quick release hose guide shown in FIG. 6.
Figure 8:
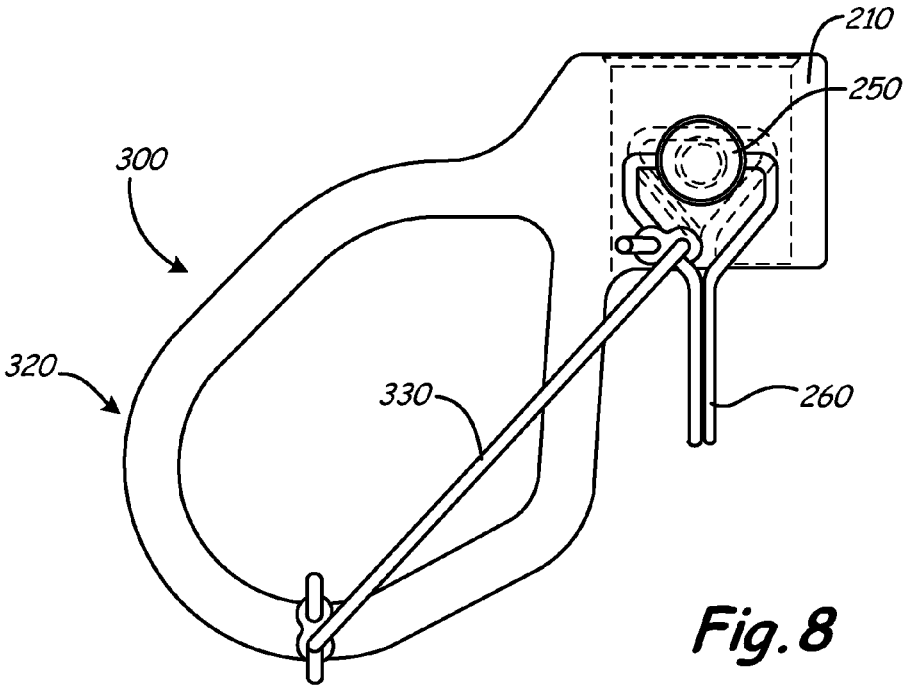
FIG. 8 is a side view of the quick release hose guide shown in FIGS. 6 and 7.
Figure 9:
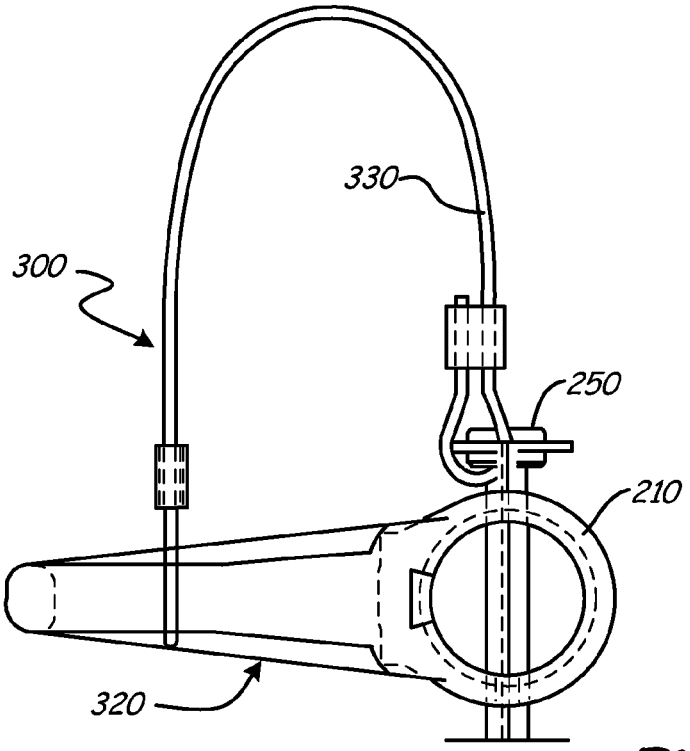
FIGS. 9 and 10 are end views of the quick release hose guide shown in FIGS. 6-8.
Figure 10:
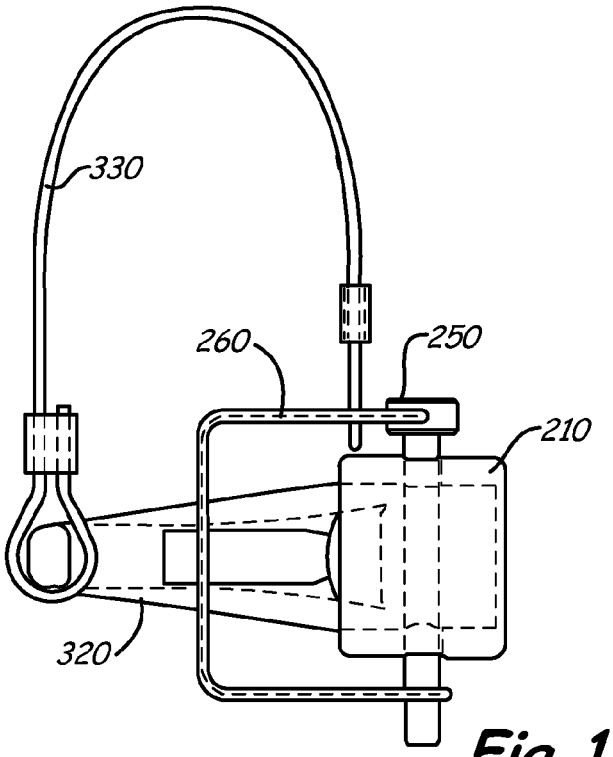

Referring now to FIG. 6, shown is a second embodiment of a quick release hose guide 300, which is similar to hose guide 200. Like hose guide 200, hose guide 300 includes sleeve 210 having a cross drill or apertures 205 and 207 (not shown in FIG. 6), which are configured to align with apertures 115 in post 110. Hose guide 300 differs slightly from hose guide 200 in the shape of the hose guiding portion. In hose guide 300, the hose guiding portion 320 does not have the D-ring shape, but can otherwise be manufactured in the same manner as described above with reference to hose guide 200 (e.g., as a single cast piece of metal, as an integrally formed piece of rubber or other materials, by attaching separately formed ring and hose guiding portions, etc.).

Referring now to FIGS. 7-10, shown are perspective, side and end views of hose guide 300 shown in FIG. 6. FIGS. 7-10 show additional features of the hose guide. As shown, hose guide 300 includes, in exemplary embodiments, quick pin 250 which is inserted through the apertures in the sleeve 210 and the apertures in the post 110 to secure the sleeve to the post. Snap clip 260 is also included in exemplary embodiments to further keep pin 250 in place to secure hose guide 300 to work machine 100. Also included with hose guide 300 is an optional cable 330 extending between hose guiding portion 320 and snap clip 260 (or pin 250) in order to keep pin 250 and clip 260 from being lost when removed from sleeve 210. Cable 330 can also be secured to other portions of hose guide 300 (e.g., to sleeve 210). Cable 330 can be included in any and all embodiments described herein, and should be interpreted as such.

Figure 11:
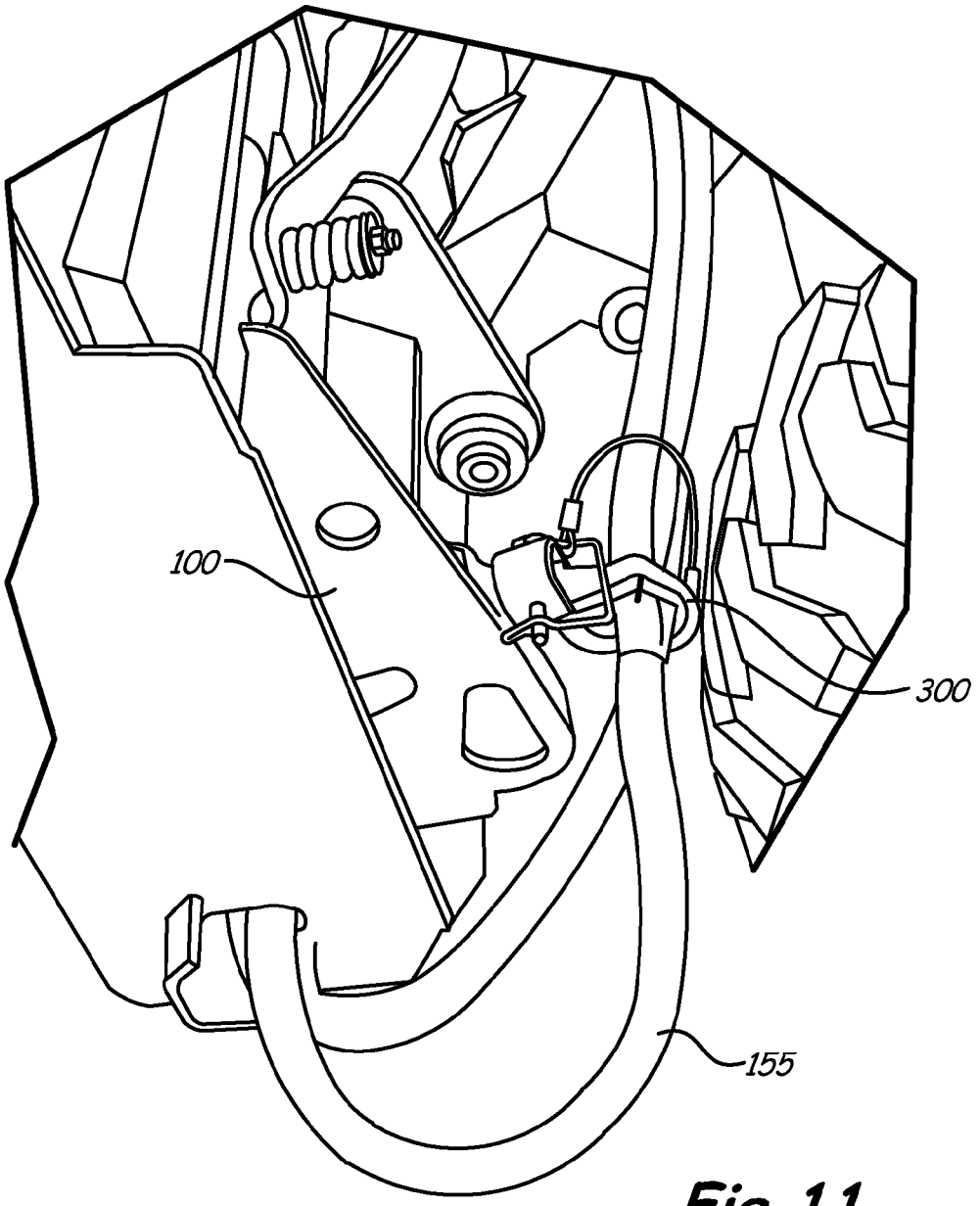
FIG. 11 is a view of a portion of a work machine having the quick release hose guide of FIG. 6 attached to an implement coupler.
Figure 12:
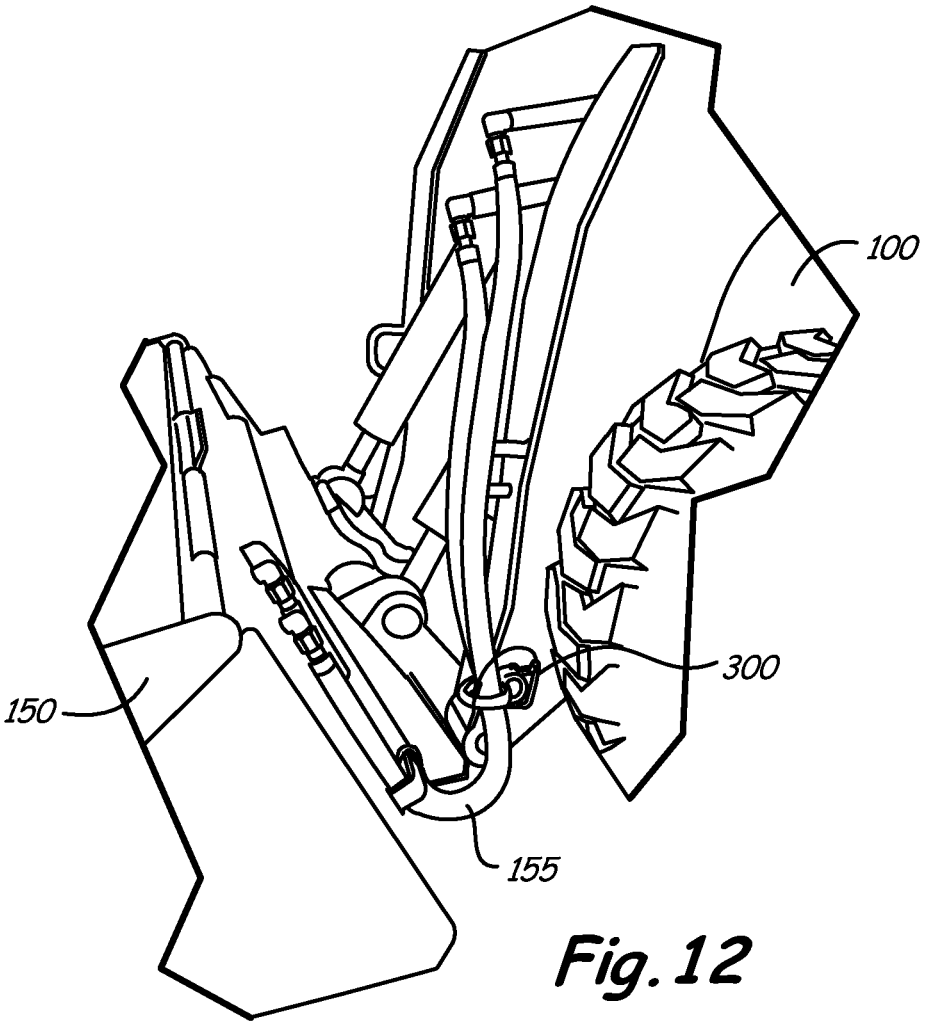
FIG. 12 is a view of a portion of a work machine having the quick release hose guide of FIG. 6 attached to an arm or side boom of the work machine.

Referring now to FIGS. 11 and 12, shown is hose guide 300 used to secure hoses 155 to different portions of work machine 100. FIG. 12 also shows attachment 150 having hoses 155. When disconnected from work machine 100, hose guide 300 can remain with attachment 150 after the quick disconnect technique described above has been performed.

Figure 13:
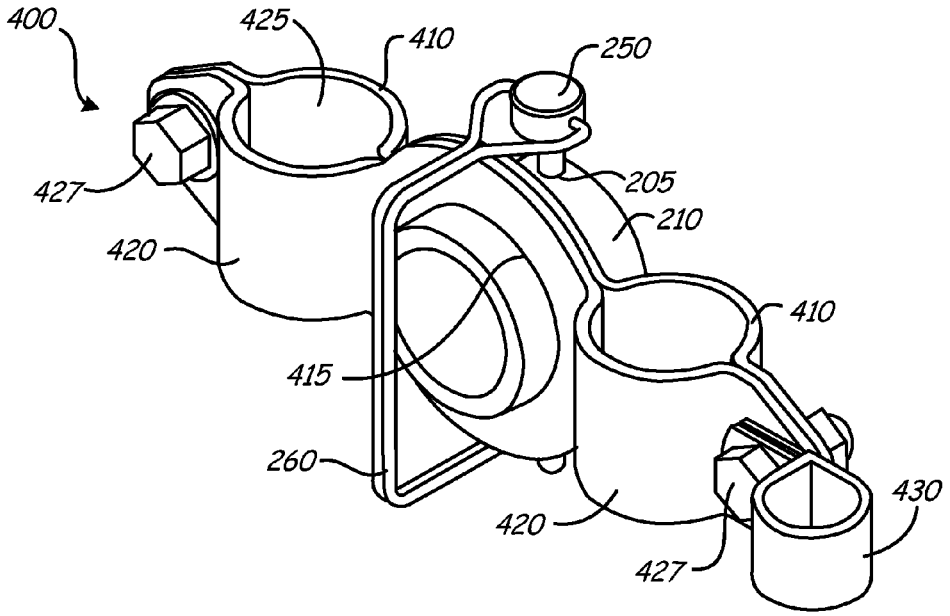
FIG. 13 is a perspective view of a third embodiment of a quick release hose guide coupling hydraulic hoses to a work machine.
Figure 14:
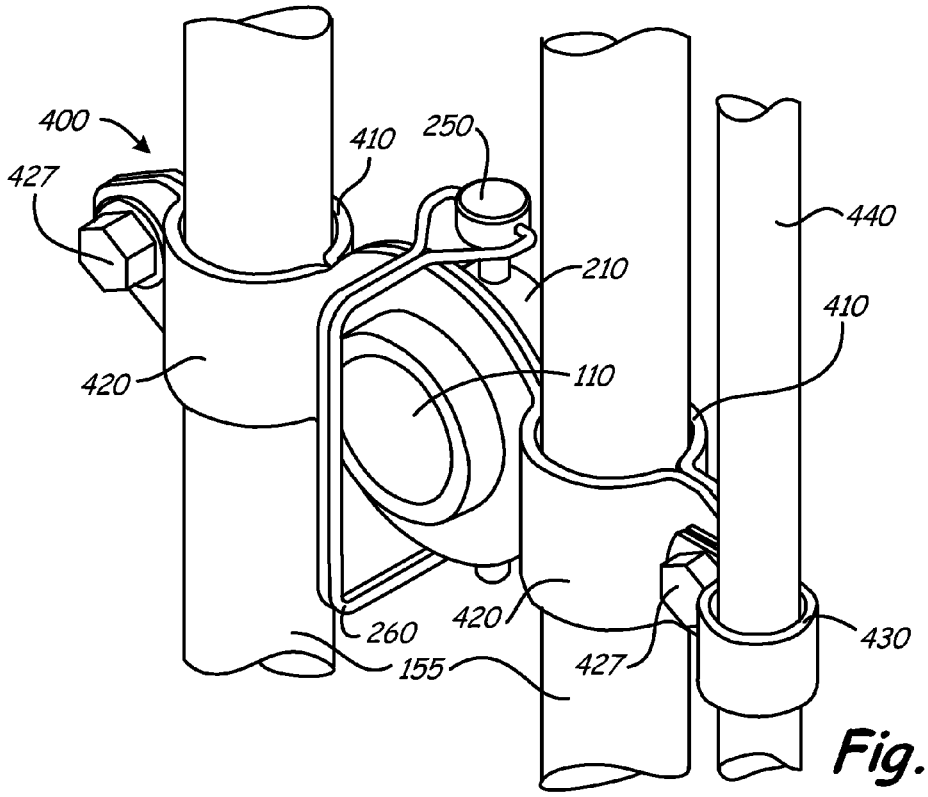
FIG. 14 is another perspective view of the quick release hose guide shown of FIG. 13, with hydraulic hoses shown.

Referring now to FIGS. 13 and 14, shown is another embodiment of quick release hose guide. Hose guide 400 differs somewhat from hose guides 200 and 300 in that hose guide 400 is of a type which can be sized to the particular hose diameters of the hoses to be secured. In exemplary embodiments, hose guide 400 comes in two halves 410 and 420 which form the hose guiding portion. When assembled, the two halves form passages or channels 425 (FIG. 13) through which hoses 155 (FIG. 14) can extend. As mentioned, the shapes of portions 410 and 420 can be designed for particular diameter hoses. During assembly, the two hose guiding portions 410 and 420 are placed together around hoses 155, and are then bolted together with nut/bolt combinations 427 (or other types of fasteners). An aperture 415 of these hose guiding portions 410 and 420 is slid over sleeve 210 in some embodiments. In other embodiments, one of the two hose guiding portions (e.g., portion 410) is formed on (or integrally with) sleeve 210, and then the other portion (e.g. portion 420) is slid onto sleeve 210 after the hoses are put in place. Fasteners 427 then hold the two halves in place on sleeve 210. Other variations of this concept can also be employed. Like other embodiments, hose guide 400 can be quickly attached to, or released from, the work machine using the quick release mechanisms (post 110, sleeve 210, pin 250, clip 260, etc.) and techniques described above. In other words, to attach hose guide 400 to the work machine in order to secure the hoses, sleeve 210 is slid onto post 110 (FIG. 14), pin 250 is placed through the corresponding apertures (e.g., aperture 205, etc. in the sleeve and post), and clip 260 is snapped in place. To remove the hose guide from the work machine, the corresponding steps are repeated in reverse order. As before, hose guide 400 can have the unique feature that, when detached from the work machine, the hose guide remains with the detached attachment or implement.

Hose guide 400 can of course be modified in design to accommodate additional hoses, and is not limited to the two hoses 155 illustrated in FIG. 14. Further, guide 400 can be modified, if desired, to place both (or all) hoses on one side of post 210. Further still, a P-clip or other retaining member 430 can be included to secure a drain tube 440 if desired.

Figure 15:
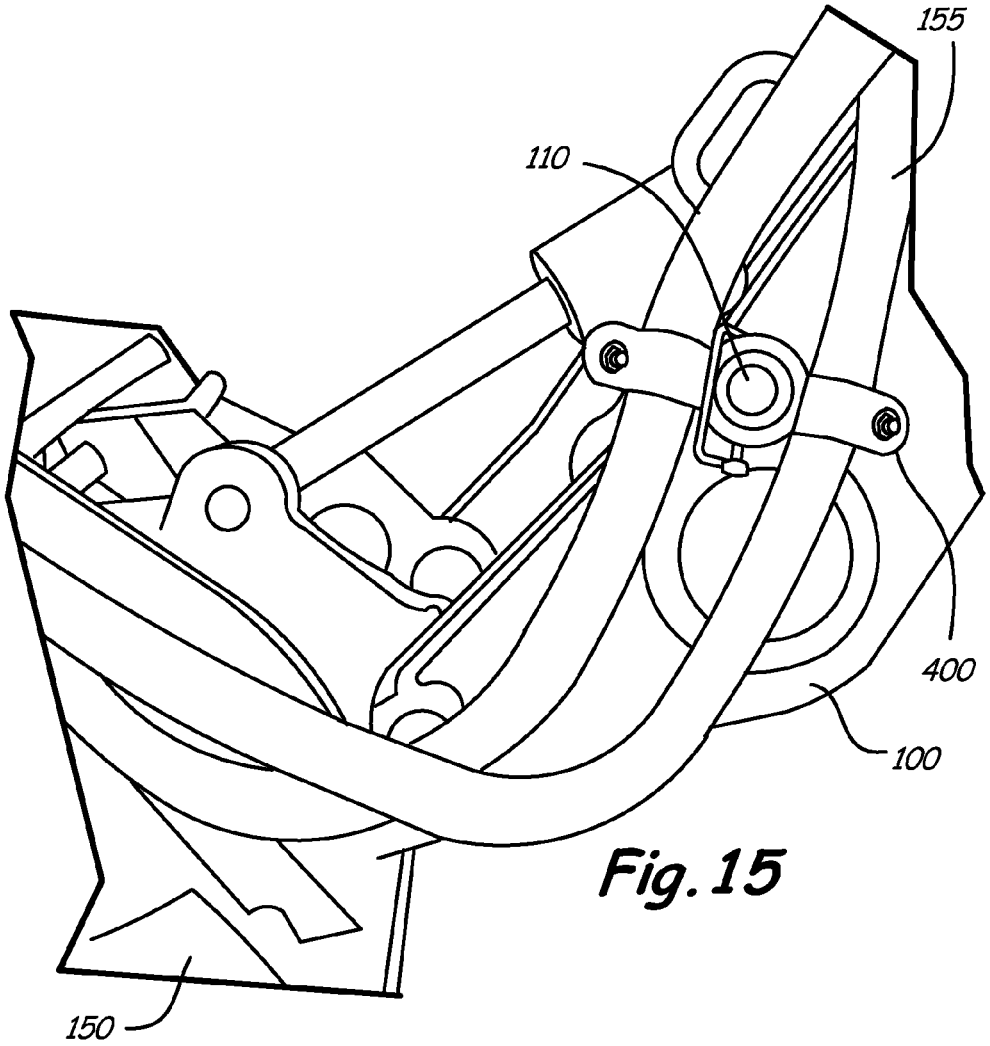
FIG. 15 is a side view of a portion of a work machine having a quick release hose guide substantially as shown in FIGS. 13 and 14 attached to an arm or side boom of the work machine.

FIG. 15 illustrates a portion of a work machine 100 and an attachment or implement 150 in which hose guide 400 is used to secure the hoses 155 from the implement to the work machine.

Figure 16:
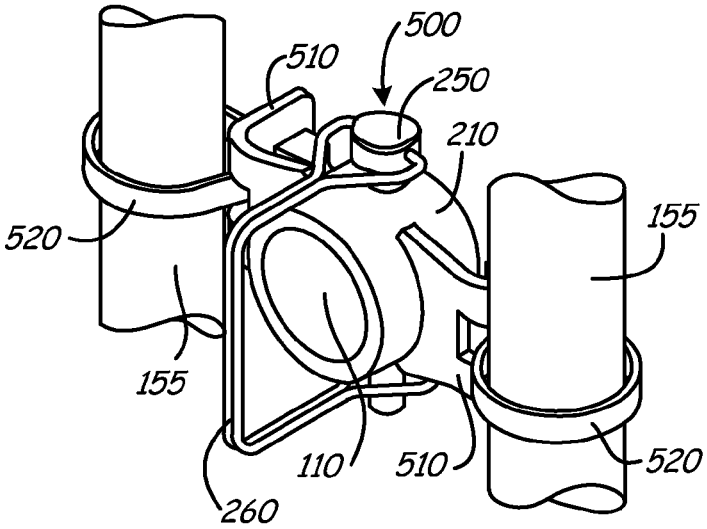
FIG. 16 is a perspective view of a fourth embodiment of a quick release house guide coupling hydraulic hoses to a work machine.
Figure 17:
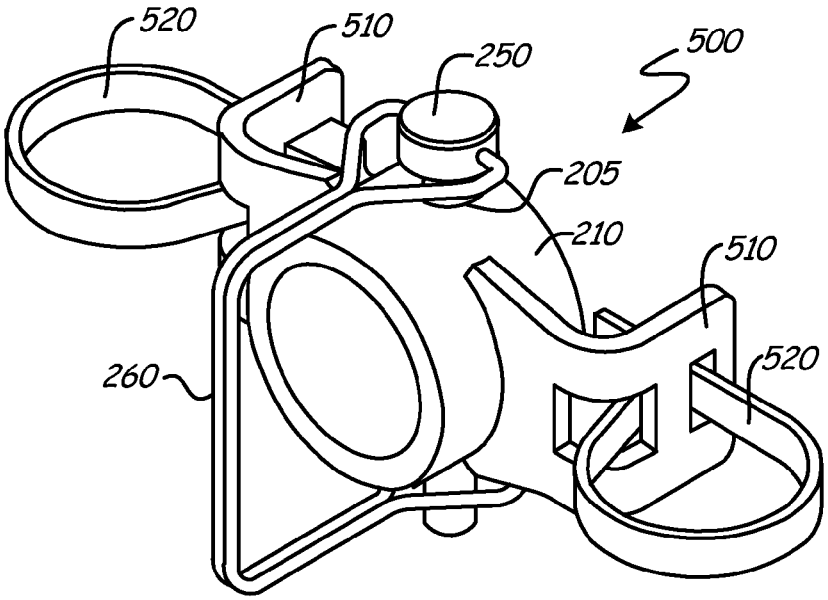
FIG. 17 is another perspective view of the quick release hose guide shown in FIG. 16.

Referring now to FIGS. 16 and 17, shown are another example embodiment of a quick release hose guide. Hose guide 500 is similar to hose guide 400 in that it can be used to accommodate different sized hoses. However, unlike hose guide 400 which can be designed to accommodate different sized hoses by the selection (during manufacturing) of the size of passages or channels (e.g., channels 425 shown in FIG. 13), hose guide 500 can be designed as a universal hose guide which conforms to any size of hydraulic hose. Like previously described embodiments (e.g., hose guides 200, 300 and 400), hose guide 500 includes a sleeve 210 designed to fit over a post 110 on the work machine. Apertures (e.g., aperture 205) in the sleeve can be aligned with apertures 115 in the post 110, and a quick release pin 250 can be inserted through the aligned apertures to secure the hose guide in place on post 110. Snap clip 260 snaps over the opposite end of pin 250 to keep the pin in place.

Unlike other embodiments, hose guide 500 includes adjustable size hose retaining members 520. Hose retaining members can be, for example, cable ties, zip ties, or other types of adjustable size retainers. Hose guide 500 also includes anchoring portions 510 which connect the hose retaining members to the sleeve 210 in order to aid in securing the hoses 155 to post 110 of the work machine. In one embodiment, anchoring portions 510 include slotted configurations in which the cable ties or other retaining members 520 can be thread in order to secure the hoses 155 to anchoring portions 510, and thus to sleeve 210 and post 110.

In some embodiments, during a manufacturing assembly process, hose guide 500 is secured to hoses of an attachment by wrapping cable ties or other retaining members around the hoses, threading the cable ties through slots in anchoring portions 510, and securing the cable ties in place. Hose guide 500 then remains with the hoses of the attachment, and is used to secure the hoses to the work machine in the manner described above (represented in FIG. 16). Also, like previously described embodiments, sleeve 210 and anchoring portions 510 of hose guide 500 can be formed by stamping, from cast aluminum or other metals, using injection molded plastics, etc.

Figure 18:
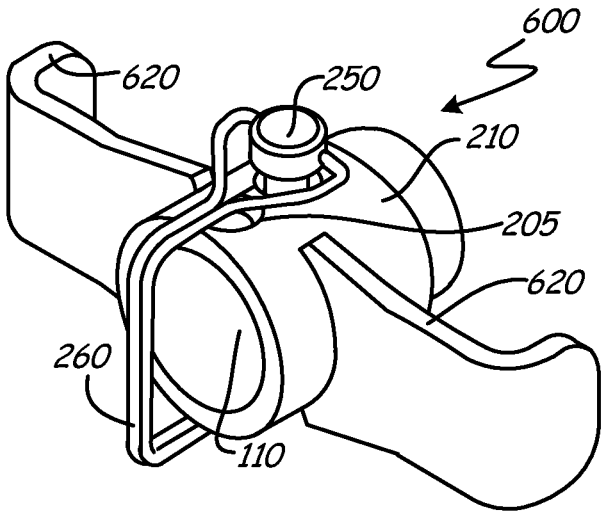
FIG. 18 is a perspective view of a fifth embodiment of a quick release house guide coupling hydraulic hoses to a work machine.
Figure 19:
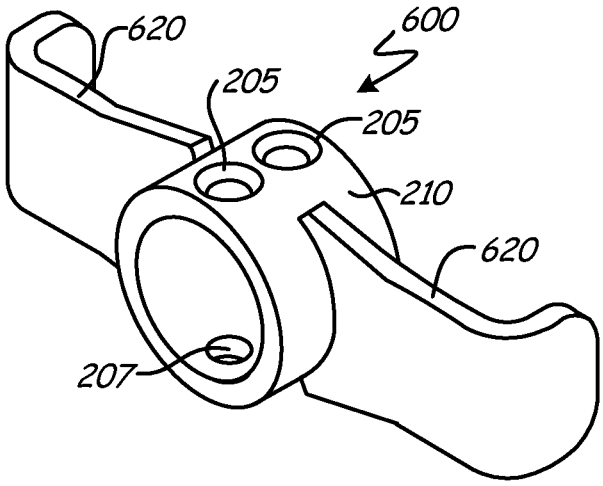
FIG. 19 is another perspective view of portions of the quick release hose guide of shown in FIG. 18.

Referring now to FIGS. 18 and 19, shown is another embodiment of a hose guide. Hose guide 600 differs somewhat from hose guides 200, 300, 400 and 500 in that it is not coupled to the hoses of an attachment when the attachment is not connected to the work machine. Instead of securing to hoses 115 of an attachment, hose guide 600 includes wing portions 620 which trap hoses 115 between the clamp and a surface of the work machine (e.g., a boom arm surface). Thus, hose guide 600 is a type of universal clamp, accommodating different hose sizes.

Figure 20:
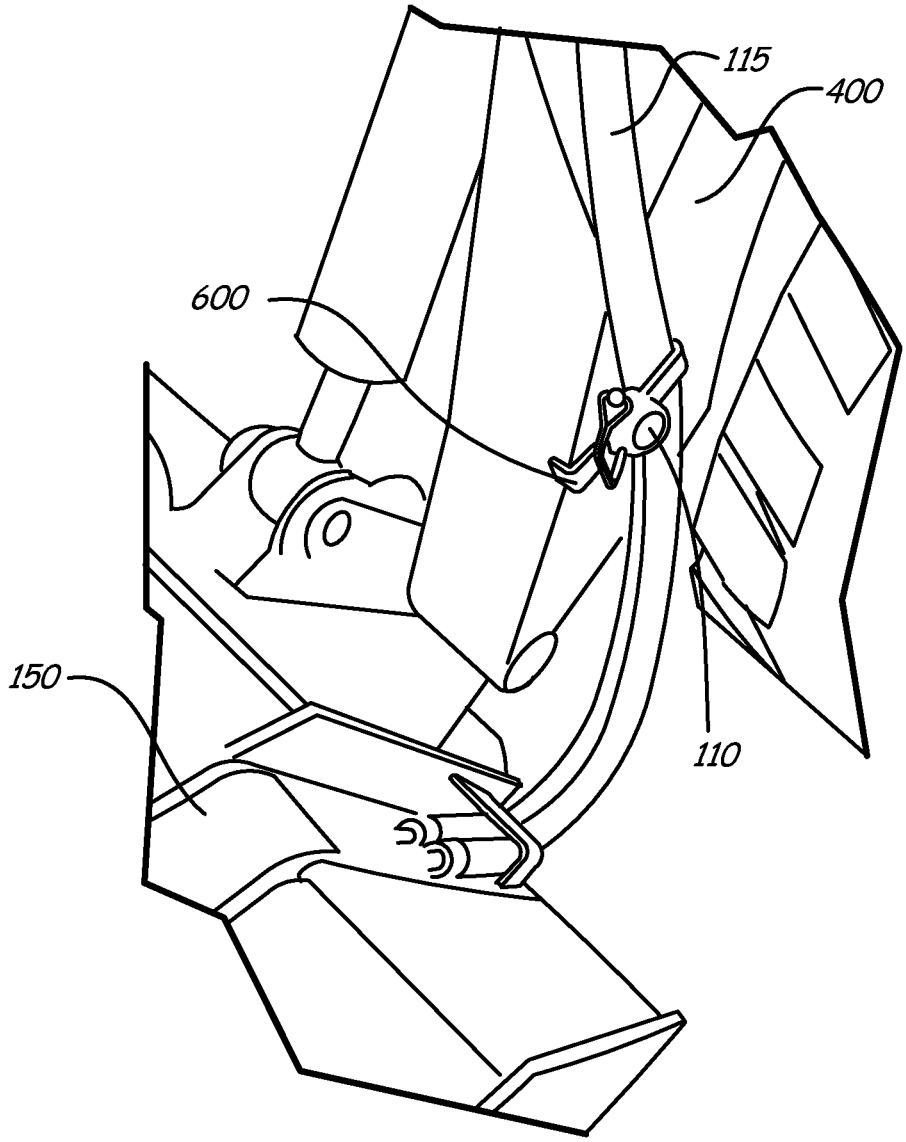
FIG. 20 is a side view of a portion of a work machine having the quick release hose guide of FIG. 18 coupled to an arm or side boom of the work machine.

Like previously described embodiments, hose guide 600 includes a sleeve 210 which slides over a post 110 on a work machine. The sleeve 210 is formed integrally with, or is coupled to, wing portions 620. Also like previously described embodiments, hose guide 600 includes aperture pairs 205 207 cross-drilled or aligned on opposite sides of sleeve 210 for purposes of aligning with apertures 115 formed in post 110. In some embodiments, hose guide 600 includes multiple pair of aligned apertures 205/207 so that different aperture pairs 205/207 can be aligned with apertures 115 in post 110 to accommodate different sized hoses (i.e., in order to create different spacing between wing portions 620 of the hose guide and a surface of the work machine). Once one of the aperture pairs in sleeve 210 is aligned with the apertures in the sleeve, pin 250 and clip 260 can be put in place to maintain the hose guide its position secured to the post of the work machine. In this position, wing portions 620 keep hoses 115 secured against the work machine 100 as shown in FIG. 20.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. For example, in various embodiments, different materials or manufacturing techniques can be used to form the various hose guides. Also, features shown in any of the above hose guides can be combined with features shown in other hose guides. Other examples of modifications of the disclosed concepts are also possible, without departing from the scope of the disclosed concepts.

What is claimed is:

1. A work machine apparatus comprising:

a hydraulically powered attachment, the hydraulically powered attachment including at least one hydraulic hose;

a work machine having a pivoting attachment carrier mounted on an arm on which the hydraulically powered attachment is removably attached, the work machine providing a hydraulic power source connectable to the hydraulically powered attachment through the at least one hydraulic hose;

a mounting post fixed to and extending from a surface of the work machine; and a quick release hose guide which guides the at least one hydraulic hose and detachably secures the at least one hydraulic hose to the work machine, the quick release hose guide comprising:

cylindrical sleeve configured to be slid over the mounting post that is fixed to the work machine, a hose guiding portion attached to the sleeve and configured to guide the at least one hydraulic hose and to secure the at least one hydraulic hose to the work machine; and a quick release attachment mechanism configured to removably secure the cylindrical sleeve to the fixed mounting post.

2. The work machine apparatus of claim 1, wherein the quick release hose guide is configured such that the at least one hydraulic hose is fed through the hose guiding portion, wherein with the at least one hydraulic hose fed through the hose guiding portion, the quick release hose guide remains with the hydraulically powered attachment and the at least one hydraulic hose when the hydraulically powered attachment is removed from the work machine.

3. The work machine apparatus of claim 1, wherein the quick release attachment mechanism further comprises a quick release pin and a pin receiving aperture in the sleeve configured to be aligned with a pin receiving aperture in the mounting post when the sleeve is mounted on the mounting post, wherein the sleeve is removably secured to the mounting post by inserting the quick release pin through the pin receiving aperture in the sleeve and through the pin receiving aperture in the mounting post.

4. The work machine apparatus of claim 3, wherein the quick release attachment mechanism further comprises a clip secured to a first end of the quick release pin, the clip disposed and arranged on the quick release pin such that, with the pin inserted through the pin receiving aperture in the sleeve and through the pin receiving aperture in the mounting post, the clip can be snapped over a second end of the quick release pin to keep the quick release pin in place.

5. The work machine apparatus of claim 4, and further comprising a cable coupled to one of the clip and the quick release pin in order to keep the clip or quick release pin from being lost when removed from the sleeve.

6. A hydraulically powered work machine attachment configured to be removably attached to a work machine, the hydraulically powered work machine attachment comprising:

at least one hydraulic hose configured to be hydraulically coupled to the work machine to provide hydraulic power from the work machine to the hydraulically powered attachment;

a quick release hose guide coupled to the at least one hydraulic hose, the quick release hose guide guiding the at least one hydraulic hose and detachably securing the at least one hydraulic hose to the work machine when the hydraulically powered attachment is attached to the work machine, the quick release hose guide comprising a cylindrical sleeve configured to be fitted over on a mounting post fixed to and extending from the work machine when the hydraulically powered attachment is attached to the work machine, a quick release attachment mechanism configured to removably secure the sleeve to the mounting post, and a hose guiding portion attached to the cylindrical sleeve and configured to guide the at least one hydraulic hose and to secure the at least one hydraulic hose to the work machine.

7. The hydraulically powered work machine attachment of claim 6, wherein the quick release hose guide is configured such that the at least one hydraulic hose is fed through the hose guiding portion, wherein with the at least one hydraulic hose fed through the hose guiding portion, the quick release hose guide remains with the hydraulically powered attachment and the at least one hydraulic hose when the hydraulically powered attachment is removed from the work machine.

8. The hydraulically powered work machine attachment of claim 6, wherein the quick release attachment mechanism further comprises a quick release pin and a pin receiving aperture in the sleeve configured to be aligned with a pin receiving aperture in the mounting post of the work machine when the sleeve is mounted on the mounting post, wherein the sleeve is removably secured to the mounting post by inserting the quick release pin through the pin receiving aperture in the sleeve and through the pin receiving aperture in the mounting post.

9. The hydraulically powered work machine attachment of claim 8, wherein the quick release attachment mechanism further comprises a clip secured to a first end of the quick release pin, the clip disposed and arranged on the quick release pin such that, with the pin inserted through the pin receiving aperture in the sleeve and through the pin receiving aperture in the mounting post, the clip can be snapped over a second end of the quick release pin to keep the quick release pin in place.

10. The hydraulically powered work machine attachment of claim 9, and further comprising a cable coupled to one of the clip and the quick release pin in order to keep the clip or quick release pin from being lost when removed from the sleeve.

11. A quick release hose guide configured to be attached to a mounting post fixed to and extending from a lift arm on a power machine having a pivoting plate configured to accept a work attachment, the quick release guide being configured to detachably secure at least one hydraulic hose from a work attachment mounted to the pivoting plate and further comprising:

a cylindrical sleeve configured to be slid over the mounting post;

a hose guiding portion attached to the sleeve and configured to guide the at least one hydraulic hose and to secure the at least one hydraulic hose to the work machine; and a quick release attachment mechanism configured to removably secure the cylindrical sleeve to the fixed mounting post.

12. The quick release hose guide of claim 11, wherein the hose guiding portion has an aperture extending therethrough, the aperture configured to accept the at least one hydraulic hose.

13. The quick release hose guide of claim 11, wherein the aperture is completely surrounded by hose guiding portion.

14. The quick release hose guide of claim 11, wherein the cylindrical sleeve and the mounting post each have an aperture such that the apertures can be aligned when the cylindrical sleeve is slid on the mounting post and further comprising:

a quick release pin configured to be inserted into the apertures on each of the cylindrical sleeve and the mounting post to secure the cylindrical sleeve to the mounting post.

15. The quick release hose guide of claim 12, wherein the cylindrical sleeve is otherwise unsecured to the mounting post.

* * * * *